US011043760B2

(12) United States Patent
Chastain et al.

(10) Patent No.: US 11,043,760 B2
(45) Date of Patent: Jun. 22, 2021

(54) PUSH-ON COAXIAL CONNECTOR

(71) Applicant: PERFECTVISION MANUFACTURING, INC., Little Rock, AR (US)

(72) Inventors: Robert J. Chastain, Maumelle, AR (US); Charles Darwin Davidson, Jr., Little Rock, AR (US)

(73) Assignee: PERFECTVISION MANUFACTURING, INC., Little Rock, AR (US)

( * ) Notice: Subject to any disclaimer, the term of this patent is extended or adjusted under 35 U.S.C. 154(b) by 0 days.

(21) Appl. No.: 16/512,263

(22) Filed: Jul. 15, 2019

(65) Prior Publication Data

US 2019/0341706 A1 Nov. 7, 2019

Related U.S. Application Data

(63) Continuation of application No. 15/643,345, filed on Jul. 6, 2017, now Pat. No. 10,374,336, which is a continuation of application No. 14/722,103, filed on May 26, 2015, now Pat. No. 9,705,211, which is a continuation-in-part of application No. 14/035,872, filed on Sep. 24, 2013, now Pat. No. 9,039,445, which is a continuation-in-part of application No. 13/527,521, filed on Jun. 19, 2012, now abandoned, and a continuation-in-part of application No. 13/374,378, filed on Dec. 27, 2011, now Pat. No. 8,636,541.

(51) Int. Cl.

| | |
|---|---|
| ***H01R 9/05*** | (2006.01) |
| ***H01R 13/52*** | (2006.01) |
| *H01R 13/03* | (2006.01) |

(52) U.S. Cl.

CPC ..... *H01R 9/0521* (2013.01); *H01R 13/5202* (2013.01); *H01R 13/035* (2013.01)

(58) Field of Classification Search

CPC ..... H01R 9/0521

See application file for complete search history.

(56) References Cited

U.S. PATENT DOCUMENTS

| | | | |
|---|---|---|---|
| 3,823,292 | A | 7/1974 | Murata |
| 3,835,443 | A | 9/1974 | Arnold et al. |
| 4,462,033 | A | 7/1984 | Grashow |
| 4,824,400 | A | 4/1989 | Spinner |
| 4,857,015 | A | 8/1989 | Michaels |
| 4,915,651 | A | 4/1990 | Bout |
| 4,934,666 | A | 6/1990 | Balsells |
| 5,061,191 | A | 10/1991 | Casciotti |
| 5,310,359 | A | 5/1994 | Chadbourne |
| 5,454,735 | A | 10/1995 | Nelson |
| 5,470,257 | A | 11/1995 | Swegda |
| 5,795,188 | A | 8/1998 | Harwath |
| 5,938,474 | A | 8/1999 | Nelson |
| 6,666,690 | B2 | 12/2003 | Ishizuka |
| 6,781,390 | B2 | 8/2004 | Kazama |

(Continued)

FOREIGN PATENT DOCUMENTS

WO WO 2010/046242 4/2010

*Primary Examiner* — Ross N Gushi

(74) *Attorney, Agent, or Firm* — Paul D. Chancellor; Ocean Law

(57) ABSTRACT

A male F-type coaxial cable connector including a nut, a body, a post, and a spacer, the spacer for bearing on the nut.

6 Claims, 15 Drawing Sheets

(56) References Cited

U.S. PATENT DOCUMENTS

| | | | | |
|---|---|---|---|---|
| 6,873,168 | B2 | 3/2005 | Kazama | |
| 7,114,990 | B2 | 10/2006 | Bence | |
| 7,131,867 | B1 | 11/2006 | Foster | |
| 7,252,546 | B1 | 8/2007 | Holland | |
| 7,479,035 | B2 | 1/2009 | Bence | |
| 7,727,013 | B1 | 6/2010 | Paynter | |
| 7,753,705 | B2 | 7/2010 | Montena | |
| 7,845,976 | B2 | 12/2010 | Matthews | |
| 7,892,005 | B2 | 2/2011 | Haube | |
| 7,892,024 | B1 | 2/2011 | Chen | |
| 8,192,237 | B2 | 6/2012 | Purdy et al. | |
| 8,282,429 | B2 | 10/2012 | Glick | |
| 8,287,320 | B2 * | 10/2012 | Purdy | H01R 9/0524 439/792 |
| 8,313,345 | B2 | 11/2012 | Purdy | |
| 8,323,060 | B2 | 12/2012 | Purdy et al. | |
| 8,337,229 | B2 | 12/2012 | Montena | |
| 8,366,481 | B2 | 2/2013 | Ehret et al. | |
| 8,393,919 | B2 | 3/2013 | Islam | |
| 8,579,658 | B2 | 11/2013 | Youtsey | |
| 9,039,446 | B2 * | 5/2015 | Youtsey | H01R 9/0524 439/584 |
| 2006/0292926 | A1 * | 12/2006 | Chee | H01R 9/0521 439/584 |
| 2011/0230091 | A1 | 9/2011 | Krenceski et al. | |
| 2012/0208407 | A1 | 8/2012 | Leon | |
| 2013/0023151 | A1 | 1/2013 | Holliday | |
| 2013/0102189 | A1 | 4/2013 | Montena | |

* cited by examiner

200B

| BODY TO POST CIRCUIT | EX POST CIRCUIT |
|---|---|
| 1a) braid to post | 1b) braid to body |
| 2a) post to body | 2b) body to nut contactor |
| 3a) body to nut contactor | 3b) nut to port |
| 4a) nut to port | |

PUSH-ON COAXIAL CONNECTOR

PRIORITY AND INCORPORATION BY REFERENCE

This application is continuation of U.S. patent application Ser. No. 15/643,345 filed Jul. 6, 2017 which is a continuation U.S. patent application Ser. No. 14/722,103 filed May 26, 2015 now U.S. Pat. No. 9,705,211 which is a continuation of U.S. patent application Ser. No. 14/035,872 filed Sep. 24, 2013 now U.S. Pat. No. 9,039,445 which is a continuation in part of U.S. patent application Ser. No. 13/527,521 filed Jul. 10, 2012 and Ser. No. 13/374,378 filed Dec. 27, 2011 now U.S. Pat. No. 8,636,541, all of which are incorporated herein by reference in their entireties and for all purposes.

This application incorporates by reference U.S. Pat. No. 7,841,896 B1 which issued from U.S. patent application Ser. No. 12/380,327 filed Feb. 26, 2009.

BACKGROUND OF THE INVENTION

Coaxial cable connectors are well-known in various applications including those of the satellite and cable television industry. Coaxial cable connectors including F-Type connectors used in consumer applications such as cable and satellite cable connectors are a source of service calls when service is interrupted by faulty and/or intermittent coaxial cable connections such as ones involving a junction between a male F-type connector terminating a coaxial cable and a female F-type port located on related equipment.

FIELD OF INVENTION

This invention relates to the electromechanical arts. In particular, the invention provides an electrical connector suitable for terminating a coaxial cable having a center conductor and a shield or ground conductor surrounding the center conductor.

DISCUSSION OF THE RELATED ART

FIG. 1 shows a prior art male F-type coaxial cable connector 100. The connector includes a nut 102 with an annular flange 109 that rotatably engages a metal post 106. The annular nut flange is positioned between a post flange 107 and a plastic body 104 affixed to the post.

The connector is for terminating a plastic jacketed coaxial cable having a central electrical conductor separated from a shield conductor such as a wire braid by a dielectric material. During installation, the post 106 is inserted between the dielectric material and the jacket, typically beneath a braid shield.

In this prior art connector, a connector rear shell 108 is for sliding over the body and fixing a coaxial cable (not shown) in a body cavity 111 via a ring member 113 carried by the rear shell. Cable/connector fixation occurs when the rear shell forces the ring member to wedge between the body and a coaxial cable inserted in the body.

As shown, the male F-type connector is for engaging a mating port 101. Engagement, such that signal and ground electrical circuits incorporating respective center and shield conductors are continued from the male F-type connector to the mating port, is intended. Skilled artisans will appreciate that in this connector a continuous ground circuit is established when the flange 107 of the metal post 106 comes into contact with an end of the mating port's metal case 103.

Notably, such connectors lack the ground path continuity enhancements of the present invention.

SUMMARY OF THE INVENTION

The present invention provides coaxial cable connectors such as a male F-type coaxial cable connector. Embodiments described herein include various features for improving electrical continuity.

A male F-type coaxial cable connector includes a nut, a body, a post, and a spacer.

In an embodiment, a male F-type coaxial cable connector comprises: a coaxially arranged nut, body, and post; the nut rotatably coupled with the body via the post; a forward spacer interposed between a post flange and a nut flange; the forward spacer bearing on the post flange and on the nut flange; a rearward spacer interposed between a body front face and the nut flange; and, the rearward spacer bearing on the body front face and on the nut flange.

BRIEF DESCRIPTION OF THE DRAWINGS

The present invention is described with reference to the accompanying figures. These figures, incorporated herein and forming part of the specification, illustrate embodiments of the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

As used herein, coupled means directly or indirectly connected by a suitable means known to persons of ordinary skill in the art. Coupled items may include interposed features such as, for example, A is coupled to C via B. Unless otherwise stated, the type of coupling, whether it be mechanical, electrical, fluid, optical, radiation, or other, is provided by the context in which the term is used.

Figure 1:
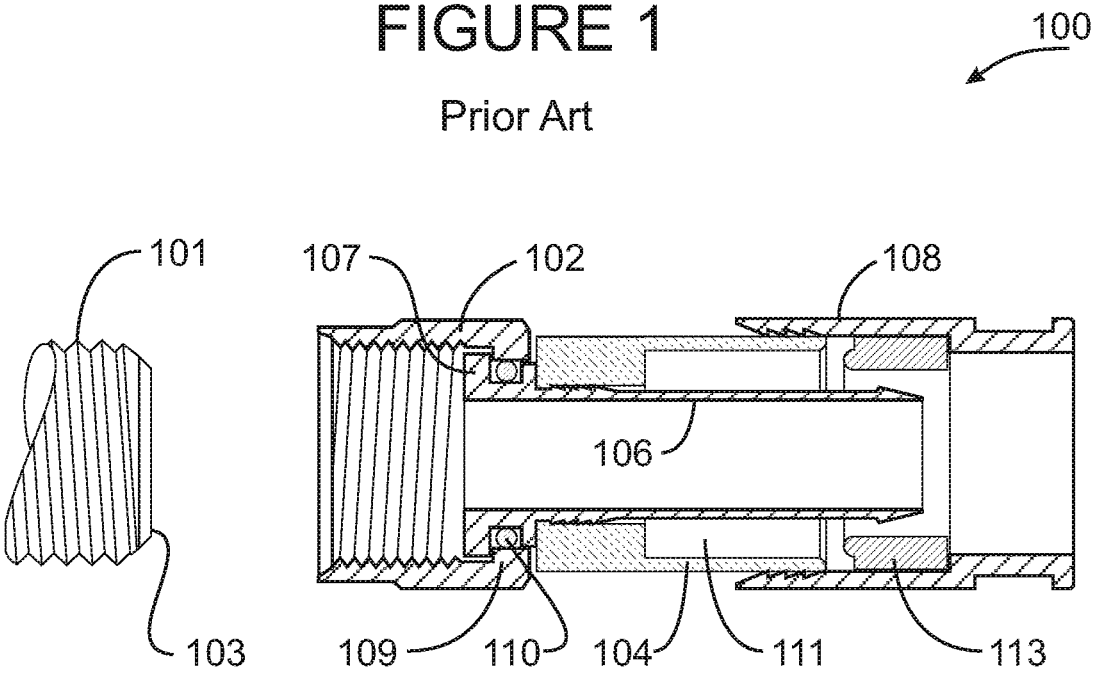
FIGURE 1 Prior Art
FIG. 1 is prior art male F-type coaxial cable connector.
Figures 2A, 2B:
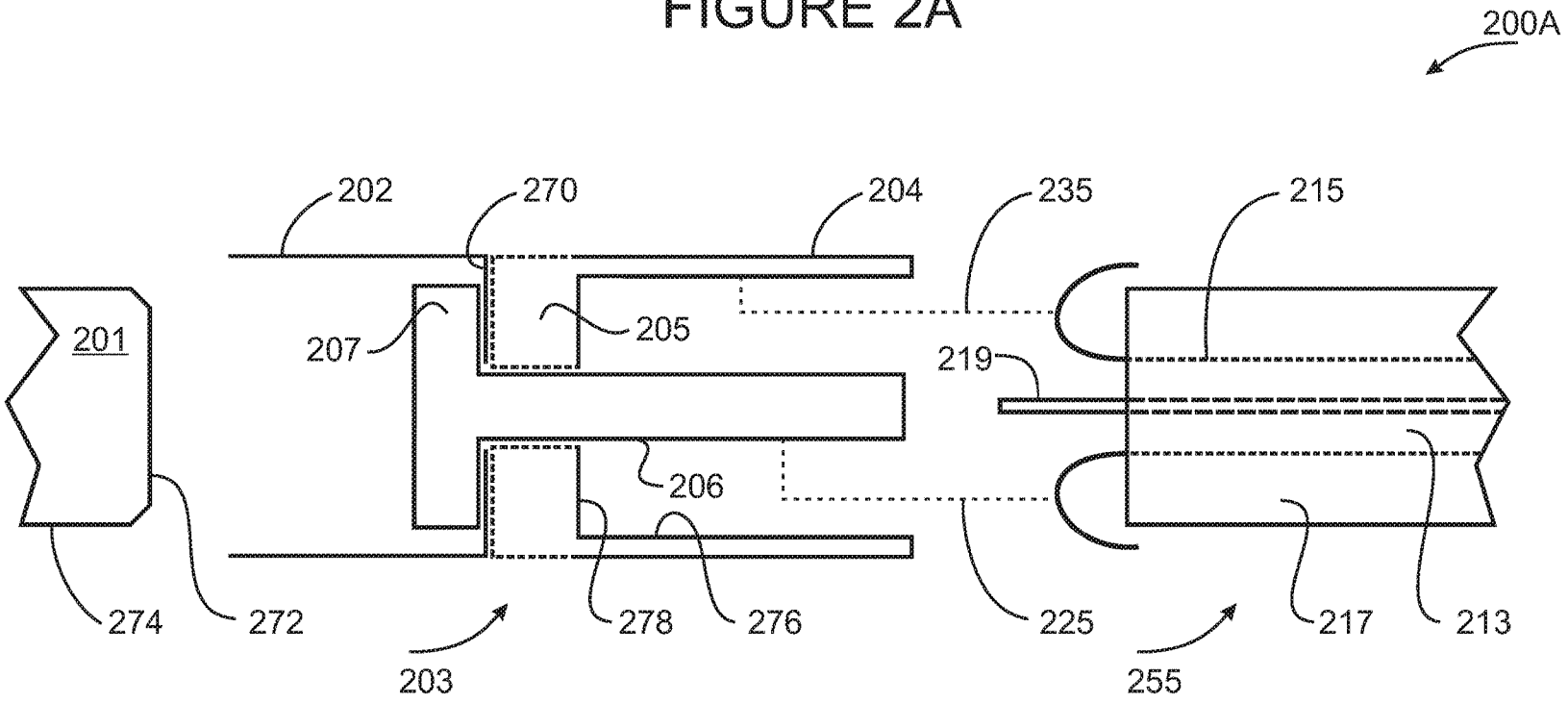
FIG. 2A is a schematic of a first embodiment of the present invention.
FIG. 2B shows a circuit table.

FIG. 2A shows an embodiment of the present invention 200A. A male F-type coaxial cable connector 203 is shown adjacent to a prepared end of a coaxial cable 255.

Connector 203 parts include a nut or similar coupling 202 retained by a flange 207 of a hollow post 206 and a body 204 fixed to the post. An annular coupling or nut flange 270 encircles the post and lies between the post flange and the body. The annular coupling flange provides for rotation of the coupling with respect to the post.

The nut is made from an electrically conductive material and/or includes an electrically conductive material, for example in a composite structure or coated structure. And, as explained in connection with FIGS. 8A-H below, the body 204 includes an electrical body circuit borne by a non-electrically conducting substrate such as a plastic body substrate.

The connector 203 provides a means for terminating a jacketed 217 coaxial cable 255 having a central electrical conductor 219 separated from a conductive shield by a dielectric material 213. In various embodiments, the conductive shield abuts the cable jacket and is formed from braided wire 215. While some coaxial cables may have one or more foil layers beneath a braided wire shield, no foil layers are shown in FIG. 2A and references to "shield" herein, unless otherwise stated, refer to a wire braid shield 215. During installation, the post 206 is inserted between the dielectric material and the shield.

A coaxial cable terminated with the connector 203 provides a means for mechanically and electrically engaging a mating port 201. As with the prior art connector, this connector provides for continuation of signal and ground electrical circuits to the mating port when the devices are engaged.

However, unlike the prior art connector, the connector 203 of FIG. 2A does not rely on electrical contact between the post flange 207 and an end 272 of the mating connector's metal case 274. Rather, as explained below, the connector includes a body circuit.

FIG. 2B shows a table 200B describing two circuits between a coaxial cable shield conductor and a mating port conductor such as a mating port's grounded case 274. The circuits are a "body to post" circuit and an "ex post circuit." As explained below, the "body to post" circuit refers to a circuit utilizing an electrically conductive post while the "ex post circuit" refers to a circuit that does not utilize an electrically conductive post.

In the body to post circuit 225, the coaxial cable shield 215 contacts an electrically conductive post such as a metal post 206. The body circuit borne by the non-conductive body interconnects the conductive post and conductive nut via an interconnect such as a body to nut contactor 205. The electrically conductive nut 202 extends the circuit to the grounded case 274 of the mating port 201. Notably, the nut 202 and the port 201 need only be in mechanical contact to establish a circuit between the shield 215 and the port case ground 274. There is no requirement for the nut to be snugly and/or tightly engaged with the port 201 or for the post flange 207 to contact the port end 272.

In the ex post circuit 235, the post 206 is not included in the circuit. In particular, the coaxial cable shield 215 contacts the body circuit borne by the non-conductive body at one or more locations such as at a body inside wall 276 and/or a body inside end 278. The plastic body's body circuit interconnects with the conductive nut via a body to nut contactor 205. The electrically conductive nut 202 extends the circuit to the grounded case 274 of the mating port 201. Notably, the nut 202 and the port 201 need only be in mechanical contact to establish a circuit between the shield 215 and the port case ground. There is no requirement for the nut to be snugly and/or tightly engaged with the mating port or for the post flange 207 to contact the port end 272.

Figure 3A:
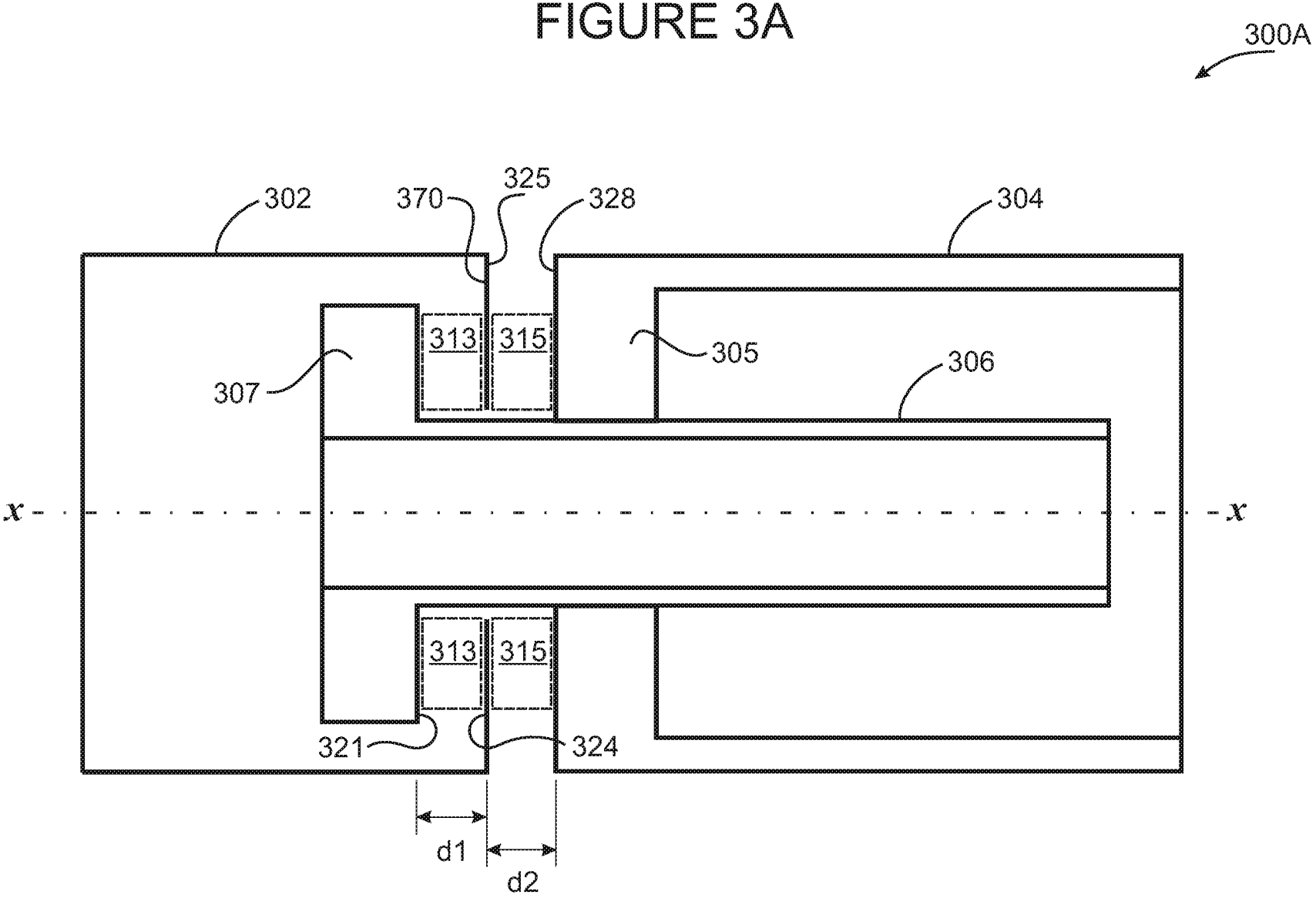
FIG. 3A is a schematic of a second embodiment of the present invention.

FIG. 3A shows an embodiment of the invention with a post spacer 313 that electrically insulates and a nut contactor in the form of a body spacer 315 that electrically conducts 300A. In various embodiments the post spacer functions include one or more of electrically insulating the post 306 from the nut 302, sealing between the nut annular flange 370 and the post flange 307, and biasing the nut. In various embodiments, body spacer functions include one or more of electrically conducting between the body and the nut, sealing between the body and the nut, and biasing the nut.

Connector parts include a nut or similar coupling 302 retained by a flange 307 of a hollow post 306 and a body 304 fixed to the post via a body neck 305. An annular coupling flange 370 encircles the post and lies between the post flange and the body. The annular coupling flange provides for rotation of the coupling with respect to the post.

The nut 302 is made from an electrically conductive material and/or includes an electrically conductive material, for example an electrically conductive composite or coating. And, as further explained in connection with FIGS. 8A-H below, the body 304 includes an electrical body circuit borne by a plastic body substrate.

As discussed above, the connector 300A provides a means for terminating a coaxial cable such as a jacketed 217 coaxial cable 255 having a central electrical conductor 219 separated from a shield conductor 215 by a dielectric material 213. During installation, the post 306 is inserted between the dielectric material and the shield as described above.

A coaxial cable terminated with the connector 300A provides a means for mechanically and electrically engaging a mating port 201. As in FIGS. 2A, B above, one or both of the "body to post" circuit and the "ex post circuit" provide an electrical interconnection between the shield conductor 215 of a terminated coaxial cable and a ground connection of a mated port such as a port case ground 274.

As shown, the connector 300A includes a body to nut contactor in the form of a conducting body spacer 315 that contacts and is between a body front face 328 and a nut trailing face 325 (second opposed surfaces, 325, 328). In various embodiments, conducting body spacer materials include any suitable electrically conducting materials and constructs such as constructs made from one or more of elastomers and plastics rendered electrically conductive through the use of conductive coatings and/or conductive materials included or suspended therein. See also selected plastics that are suited to application of electrically conductive materials and coatings discussed below.

The connector also includes an insulating post spacer 313 that contacts and is between a post flange rear face 321 and a nut flange front face 324 (first opposed surfaces, 321, 324). In various embodiments, the post spacer includes one or more suitable electrical insulating materials such as non-electrically conducting plastics.

In some embodiments, the insulating post spacer 313 is also an environmental seat And, in some embodiments, the spacers 313, 315 are resilient members which are deformable such that the spacers substantially recover an original uncompressed shape when deforming forces are removed. As skilled artisans will understand, resilient spacers are operable to exert opposed forces on the nut flange 370 such that movement of the nut flange tends to be followed by the contracting or expanding spacers.

Figure 3B:
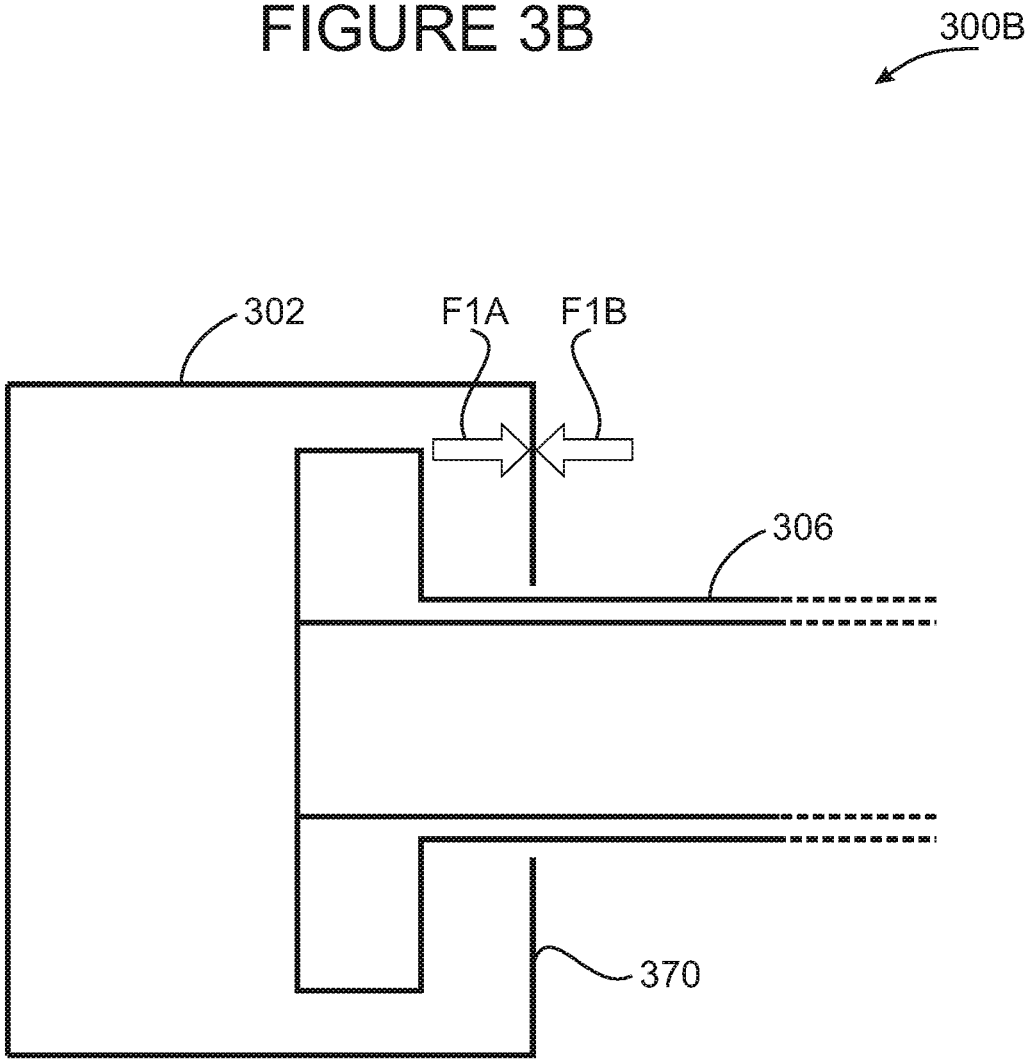
FIG. 3B is a force diagram.

See for example FIG. 3B showing the nut flange 370 acted on by opposed forces 300B. Here, opposed post spacer force F1A and body spacer force F1B are shown acting on the nut flange.

In various embodiments, changes in post spacer axial dimension d1 match changes in the gap between the post flange rear face 321 and the nut flange forward face 324 such that the post spacer remains in contact with the opposed faces. Similarly, changes in body spacer axial dimension d2 match changes in the gap between the nut flange rear face 325 and the body front face 328 such that the body spacer remains in contact with the opposed faces. For example, in various embodiments the sum d1 plus d2 equals a constant.

Figure 4A:
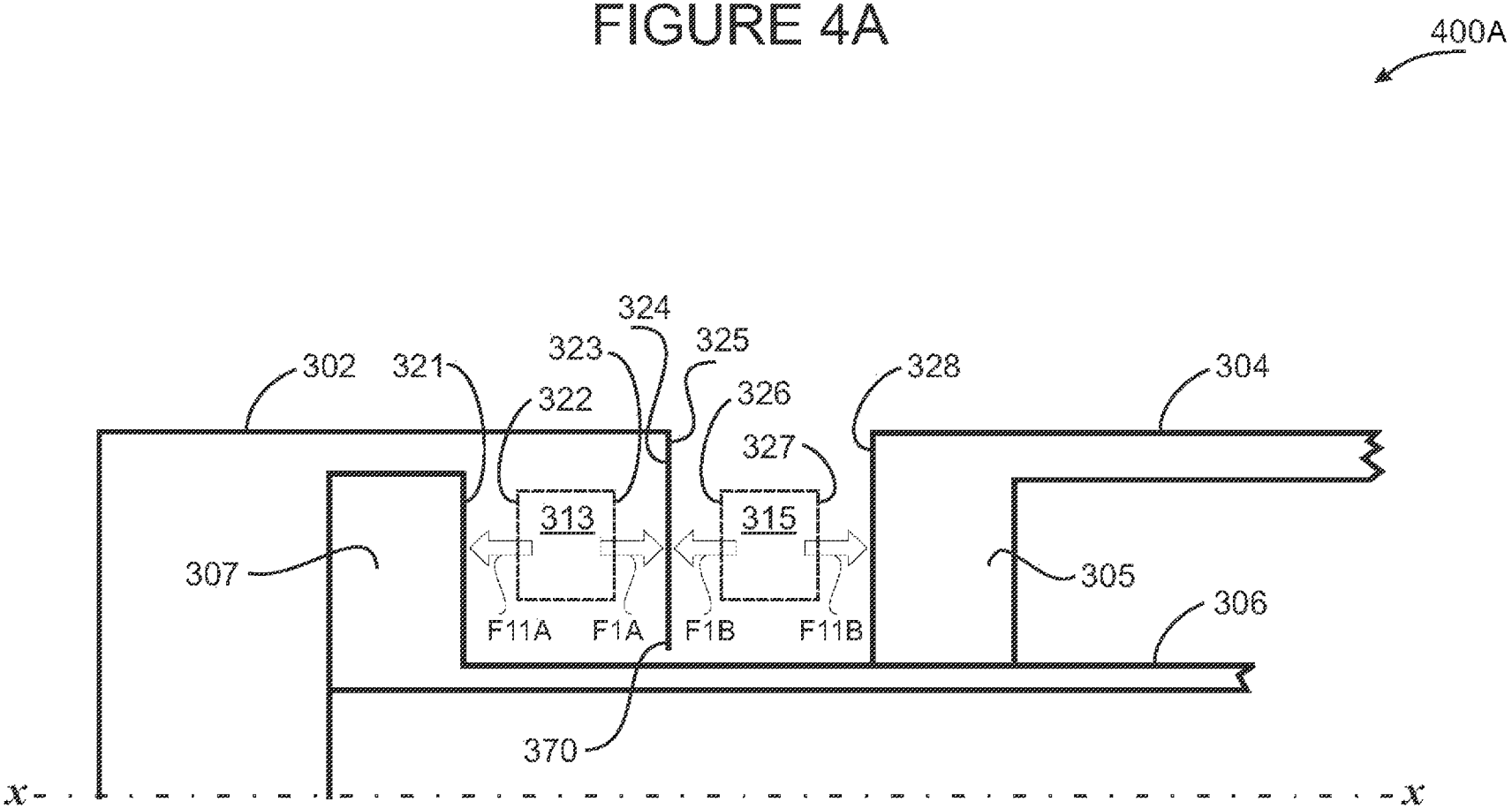
FIG. 4A is an enlarged exploded view of portions of FIG. 3A.

FIG. 4A shows an enlarged and partially exploded view of the spacers in situ 400A. This view facilitates identification of the connector parts by separating them for illustrative purposes. Hence, the spacers 313, 315 are not shown in contact with adjacent surfaces.

As mentioned above, the post spacer 313 exerts a force F1A on the nut flange 370 forward face 323 and the body spacer 315 exerts a force F1B on the nut flange rear face 325. In various embodiments, a force F11A that is opposite and substantially equal to F1A is exerted by the post spacer on the post flange rear face 321. The forces F1A and F11A are applied by respective generally opposed post spacer faces 322, 323. And, in various embodiments, a force F11B that is opposite and substantially equal to F1B is exerted by the body spacer on the body front face 328. The forces F1B and F11B are applied by respective generally opposed body spacer faces 326, 327.

Figure 4B:
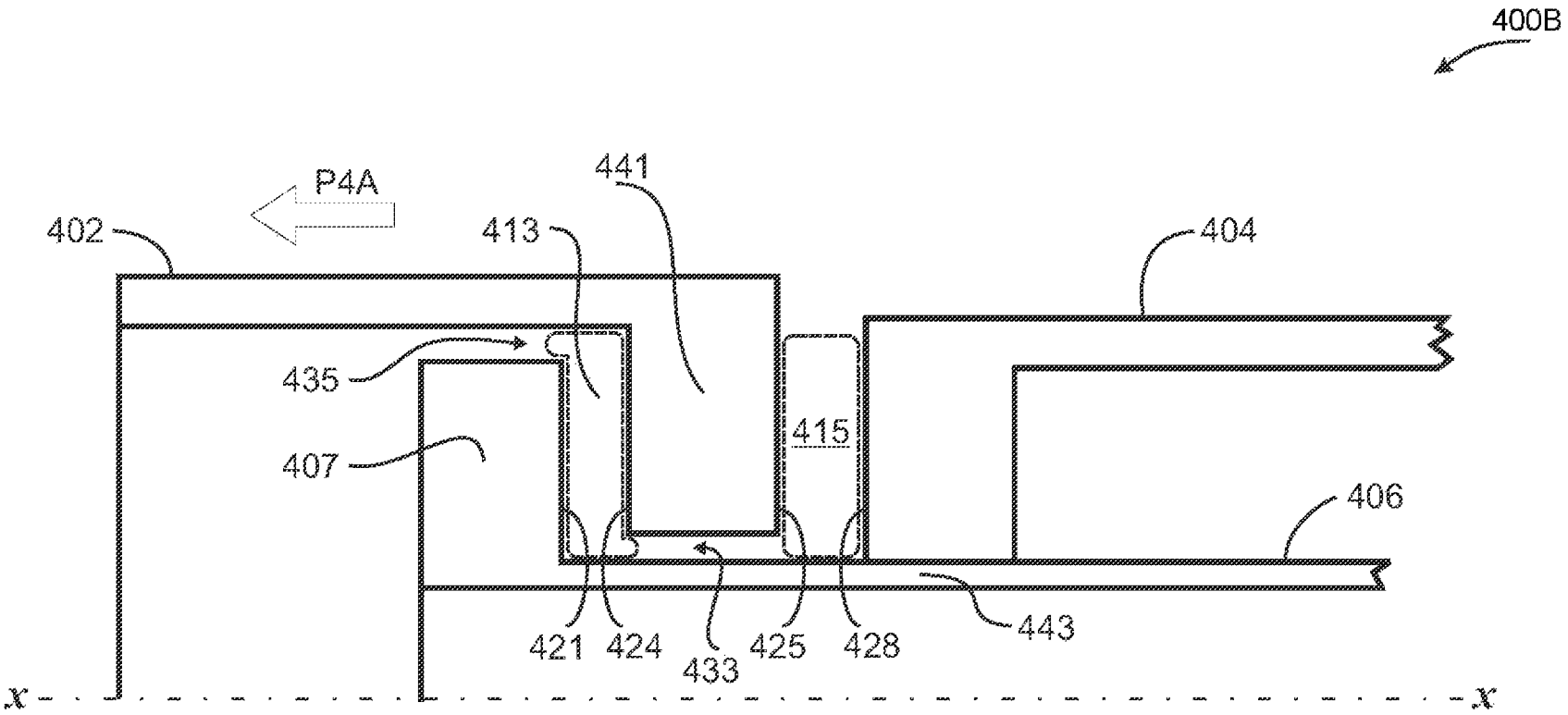
FIGS. 4B-C are enlarged exploded views of an embodiment of the present invention.
Figure 4C:
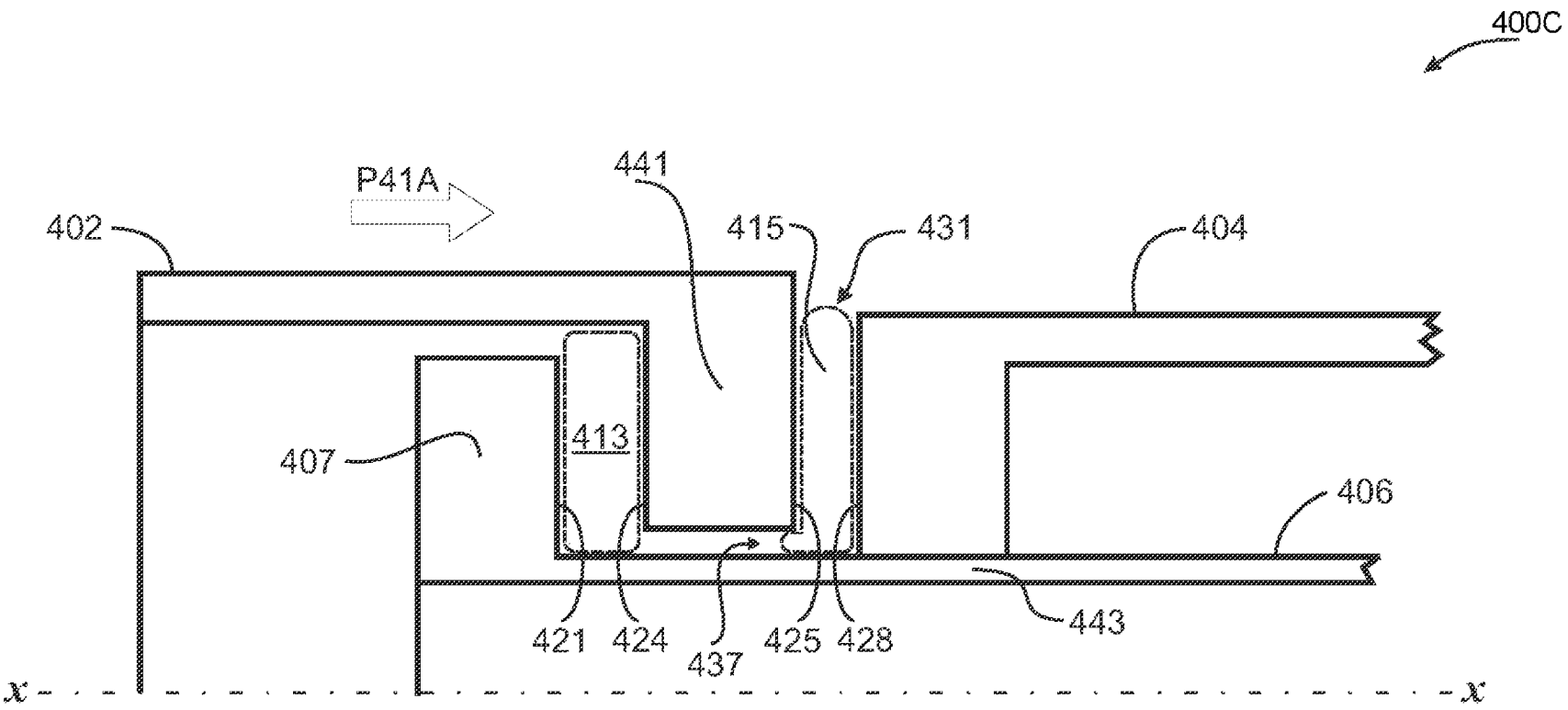

FIGS. 4B-C show embodiments 400B, 400C of a coaxial connector having a post spacer/seal 413 that provides a first compliant environmental seal. Environmental sealing includes any of sealing against ingress of water and other contaminants. In some embodiments a similar body spacer/seal 415 provides a second environmental seal.

FIG. 4B shows a nut 402 in a position P4A, a post seal 413 is compressed. Here, the post seal is squeezed between a front face 424 of a nut flange 441 and a rear face 421 of a post flange 407. As shown, the squeezed post seal deforms to fill a first void 435 between the nut and post flange and a second void 433 between the nut flange and a post mandrel 443. When the post seal is squeezed in position P4A, a body seal 415 is allowed to expand but remains in contact with a nut flange rear face 425 and a body 404 front face 428.

FIG. 4C shows nut 402 in position P41A where the body seal 415 is compressed. Here, the body seal is squeezed between a nut flange rear face 425 and the body front face 428. As shown, the squeezed body seal deforms radially outward into a third void 431 between nut flange rear face and body front face. The body seal also deforms into a fourth void 437 between the nut flange and post mandrel 443. In position P41A the post seal 413 is allowed to expand but remains in contact with a post flange rear face 421 and the nut flange front face 424.

As skilled artisans will appreciate, position P4A will result when advancing the nut 402 on a mating port 201 brings the post flange 407 into contact with the port end 272 such that the post seal 413 is squeezed between the nut and the post flange. In similar fashion, position P41A will result when backing the nut off of the mating port allows the post seal to expand while the body seal 415 is compressed as the post flange tends to return to an equilibrium position.

Suitable materials for the post spacer include non-conductive resilient elastomers and plastics. Depending upon factors such as spacer shape, environment of use, freedom of nut rotation, sealing capability, compressibility, and durability, suitable materials can be selected. For example, suitable materials will typically include natural and synthetic rubbers, saturated and unsaturated rubbers, thermoplastic elastomers, silicone, fluorosilicone, polytetrafluoroethylene (PTFE), ethylene propylene diene monomer (EPDM), polyurethane, poly vinyl chloride (PVC), acrylonitrile butadiene styrene (ABS), low density polyethylene (LDPE), high density polyethylene (HDPE), and similar materials.

FIGS. 5A-G show various cross sections of annular spacers 500A-G. With an appropriate selection of materials, these spacer cross-sections provide alternative designs for both the post spacer 313 and the body spacer 315.

Figure 5A:
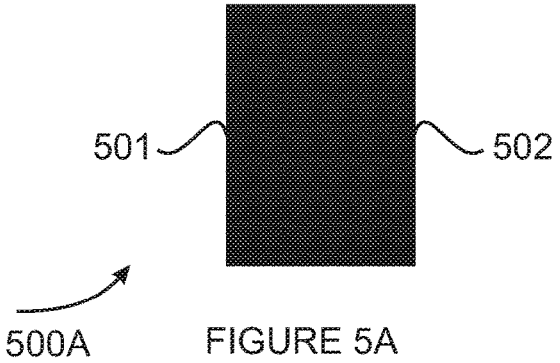
FIGS. 5A-G are spacer cross sections.

The rectangle like cross-section 500A of FIG. 5A provides opposed surfaces 501, 502 for engaging respective first opposed surfaces 321, 324 and/or second opposed surfaces 325, 328.

Figure 5B:
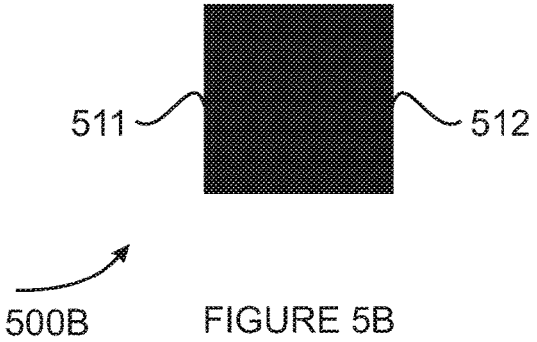

The square like cross-section 500B of FIG. 5B provides opposed surfaces 511, 512 for engaging respective first opposed surfaces 321, 324 and/or second opposed surfaces 325, 328.

Figure 5C:
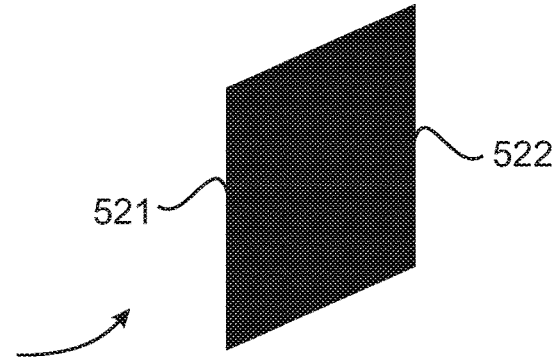

The parallelogram like cross-section 500C of FIG. 5C provides opposed surfaces 521, 522 for engaging respective first opposed surfaces 321, 324 and/or second opposed surfaces 325, 328.

Figure 5D:
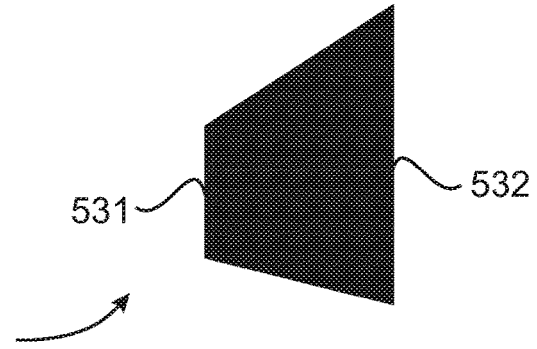

The trapezoid like cross-section 500D of FIG. 5D provides opposed surfaces 531, 532 for engaging respective first opposed surfaces 321, 324 and/or second opposed surfaces 325, 328.

Figure 5E:
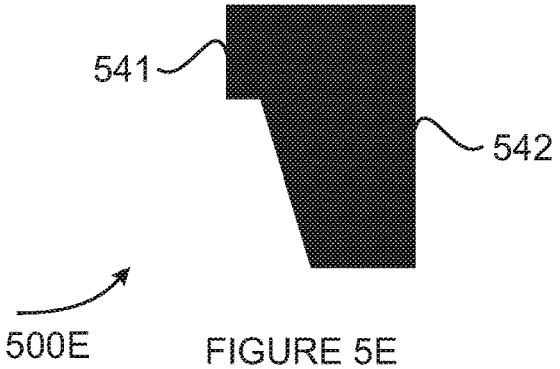

The superposed rectangle and truncated triangle (6-sided) like cross-section 500E of FIG. 5E provides opposed surfaces 541, 542 for engaging respective first opposed surfaces 321, 324 and/or second opposed surfaces 325, 328.

Figure 5F:
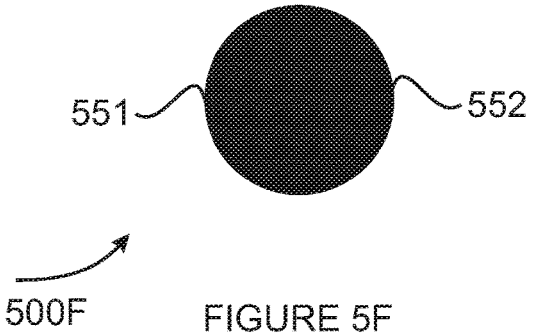

The circular cross-section 500F of FIG. 5F provides opposed arc-like surfaces 551, 552 for engaging respective first opposed surfaces 321, 324 and/or second opposed surfaces 325, 328.

Figure 5G:
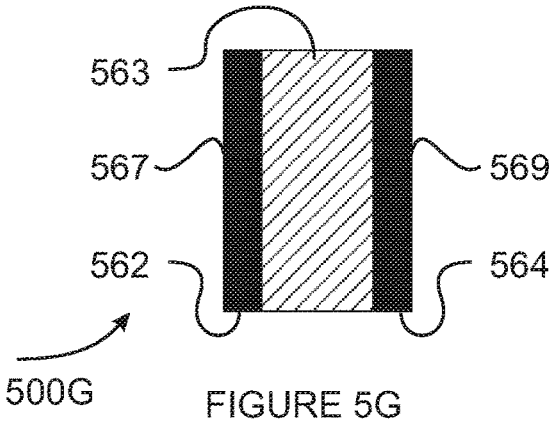

The composite rectangle like cross-section 500G of FIG. 5G provides opposed surfaces 567, 569 for engaging respective first opposed surfaces 321, 324 and/or second opposed surfaces 325, 328. As shown, this spacer provides a composite or "sandwiched" structure having outer layers 562, 564 presenting respective outer surfaces 567, 569 and a central layer 563 between the outer layers. Such structures provide means to independently adjust features such as compressibility, resiliency and surface friction. For example, a post spacer 313 design using a multi-layer structure like that of FIG. 5G might employ a central rubber layer and outer layers made of an ABS or PVC type plastic. Such a structure can offer a relatively more compressible center between relatively lower surface friction outer layers.

Figure 6:
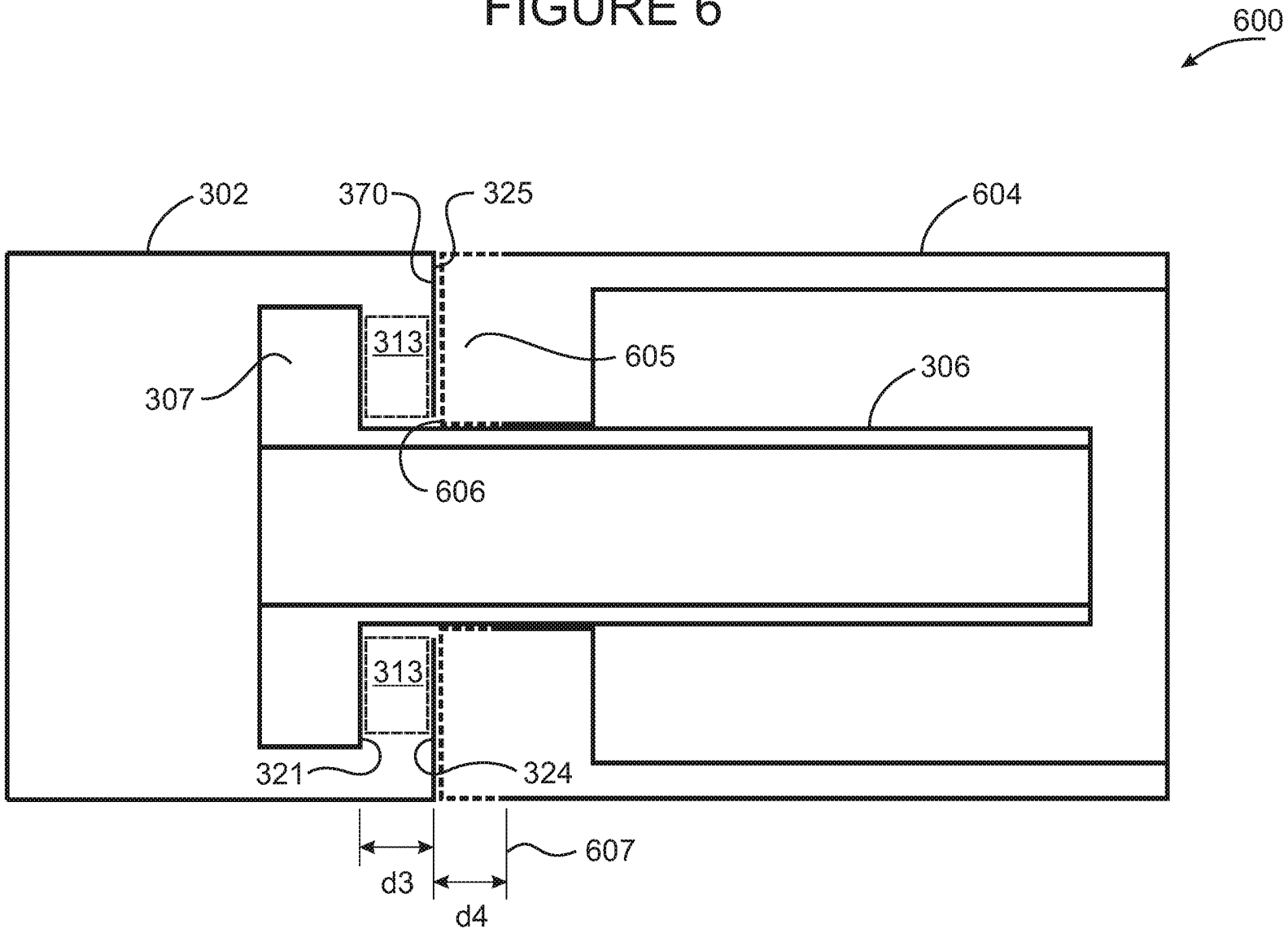
FIG. 6 is a schematic of a third embodiment of the present invention.

FIG. 6 shows an embodiment of the invention with a post spacer that electrically insulates and a nut contactor in the form of a deformable body part that conducts electricity 600. In various embodiments the post spacer functions 313 include one or more of electrically insulating the post 306 from the nut 302, sealing between the nut annular flange 370 and the post flange 307, and biasing the nut. In various embodiments, the deformable body part 605 functions include one or more of electrically conducting between the body and the nut, sealing between the body and the nut, and biasing the nut.

Connector parts include a nut or similar coupling 302 retained by a flange 307 of a hollow post 306 and a body 604 fixed to the post. An annular coupling flange 370 encircles the post and lies between the post flange and the body. The annular coupling flange provides for rotation of the coupling with respect to the post.

The nut 302 is made from an electrically conductive material and/or includes an electrically conductive material, for example an electrically conductive composite or coating. And, as further explained in connection with FIGS. 8A-H below, the body 604 includes a body electrical circuit borne by a body plastic substrate.

As discussed above, the connector 600 provides a means for terminating a coaxial cable such as a jacketed 217 coaxial cable 255 having a central electrical conductor 219 separated from a shield conductor 215 by a dielectric material 213. During installation, the post 306 is inserted between the dielectric material and the shield.

A coaxial cable terminated with the connector 600 provides a means for mechanically and electrically engaging a mating port 201. As explained in connection with FIGS. 2A, B above, one or both of the "body to post" circuit and the "ex post circuit" provide an electrical interconnection between the braid of a terminated coaxial cable shield 215 and a grounded case of a mated port 274 via a body to nut contactor 205.

As shown, the connector 600 includes a body to nut contactor in the form of a deformable body part 605 with a front portion 606. The portion of the deformable body part such as the front face contacts the nut at a location such as the nut flange back face 325.

In various embodiments, the deformable body part 605 is resilient. And, in various embodiments, the deformable body part includes a portion of the body plastic substrate and a portion of the body circuit. See FIGS. 8A-H and the related description below including body circuit descriptions.

The connector also includes an insulating post spacer 313 that contacts and is between a post flange rear face 321 and a nut flange front face 324 (first opposed surfaces, 321, 324). In various embodiments, insulating post spacer materials include any suitable electrically insulating material such as non-electrically conducting plastics.

In various embodiments, the spacer 313 is a resilient member that is deformable such that the spacer substantially recovers an original uncompressed shape when deforming forces are removed. As skilled artisans will understand, a resilient spacer is operable to exert opposed forces on the nut flange 370 such that movement of the nut flange tends to be followed by the contracting or expanding spacer. So too does the deformable body part 605 tend to follow movement of the nut flange.

In various embodiments, changes in post spacer axial dimension d3 match changes in the gap between the post flange rear face 321 and the nut flange forward face 324 such that the post spacer remains in contact with the opposed faces. Similarly, changes in deformable body part dimension d4 match changes in the gap between the nut flange rear face 325 and a body reference line 607 adjacent to the deformable body part 605 such that the body remains in contact with the nut.

Figure 7:
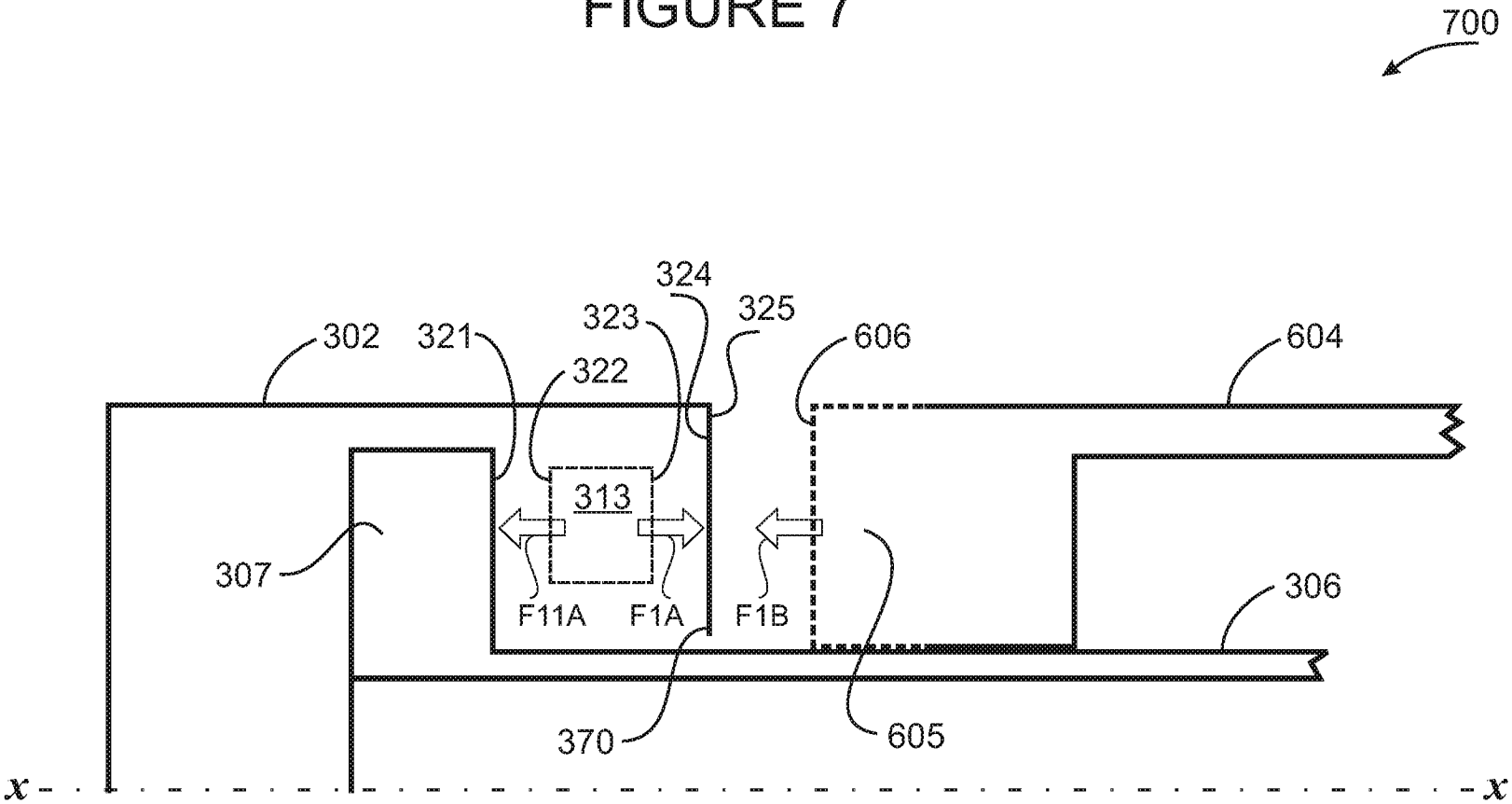
FIG. 7 is an enlarged exploded view of portions of FIG. 6.

FIG. 7 shows an enlarged and partially exploded view of the spacer and deformable body part in situ 700. This view facilitates identification of the connector parts by separating them for illustrative purposes. Hence, the spacer 313 and the deformable body part 605 are not shown in contact with adjacent surfaces.

As shown, the post spacer 313 exerts a force F1A on the nut flange 370 and the deformable body part exerts a force F1B on the nut flange. In various embodiments, a force F11A that is opposite and substantially equal to F1A is exerted by the post spacer on the flange back face 321. The forces F1A and F11A are applied by respective generally opposed post spacer faces 322, 323. Materials suited to the post spacer 313 are described above. Materials suited to the deformable body part are further described below.

FIGS. 8A-H are partial body cross-sections 800A-H. These cross-sections show illustrative embodiments of a body 604 including a non-electrically conducting substrate 890 and a body circuit borne by the substrate. A deformable body part 605 at one end of the body 604 provides a means for making a resilient electrical connection with a connector nut 302.

Figure 8A:
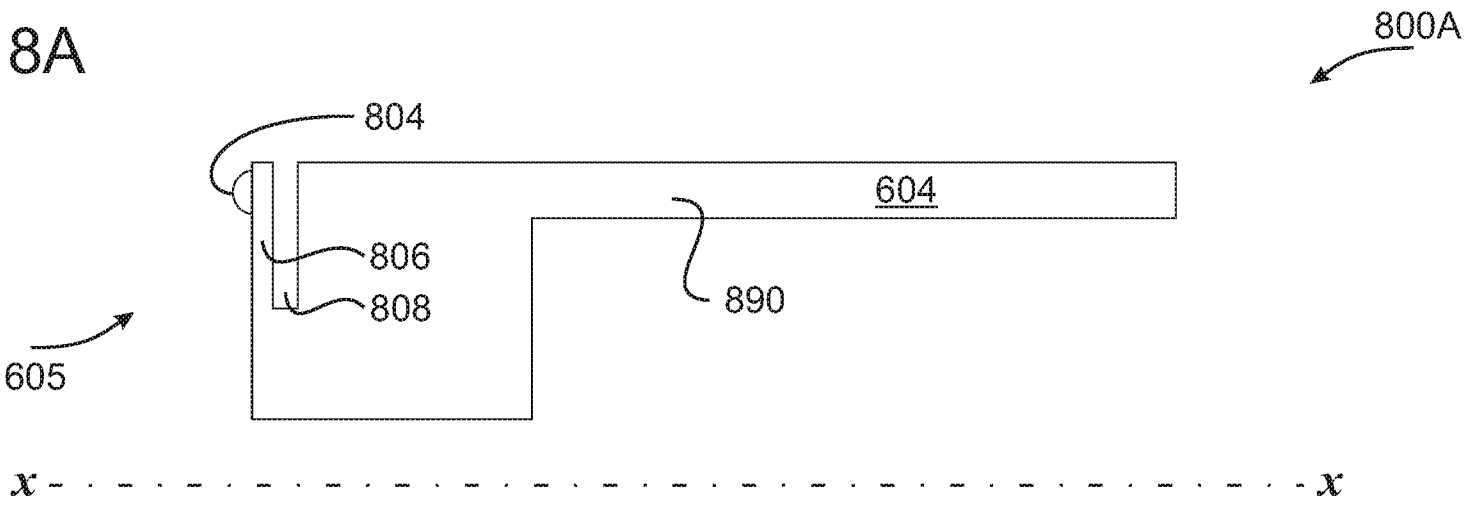
FIGS. 8A-H are partial body cross-sections.

Referring to body portion 800A of FIG. 8A, the deformable body part 605 of the body 604 includes a deformable end part. In various embodiments, a continuous or segmented body end flange 806 formed. And, in various embodiments the end flange is formed by one or more circumferentially arranged body grooves 808. A contact point on the flange such as a raised contact 804 provides for a resilient nut 302 contacting action such as when the raised contact presses against the nut flange rear face 325. In some embodiments wettable surfaces of the body are coated, for example during submersion, with an electrical conductor. Such a conductive coating application enables both of the above mentioned "body to post circuit" and the "ex post circuit." In other embodiments, only portions of the wettable body surface bear an electrically conductive coating.

Figure 8B:
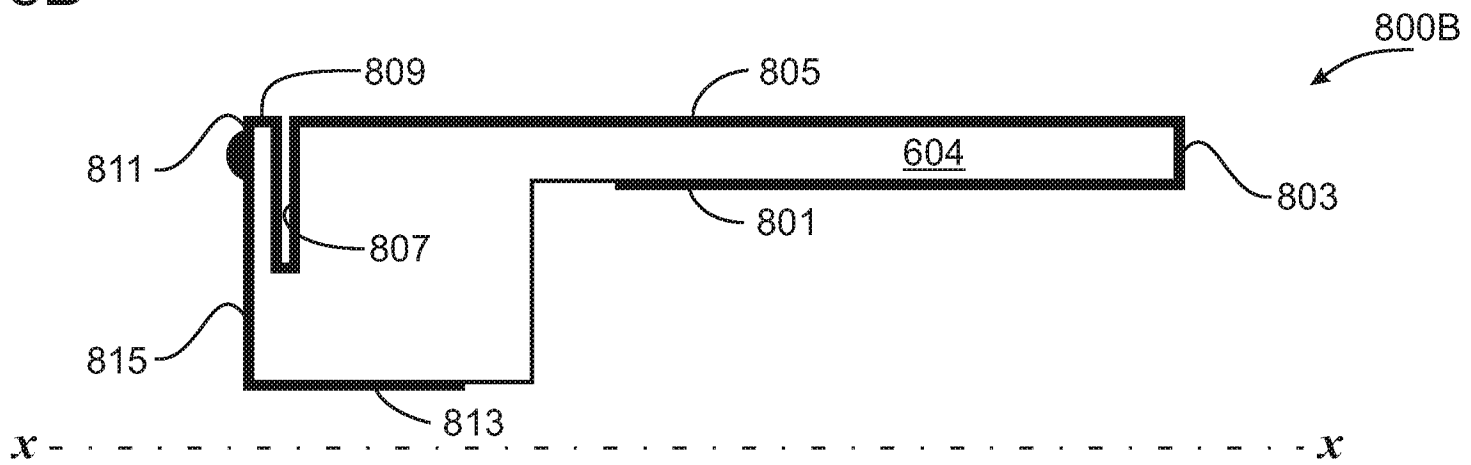

Referring to the body portion 800B of FIG. 8B, the figure illustrates the body of FIG. 8A with a first partial body coating that enables the body to post circuit and/or a second partial body coating that enables the ex post circuit. Coated body regions enabling the body to post circuit include body throat coating where the body grasps a metal post 813 interconnecting body forward end, inner coating 815 terminating at a nut contact point such as a raised contact 804 which may be electrically conductive or rendered conductive by the body circuit coating. Coated body regions enabling the ex post circuit include body inside wall coating 801 interconnecting with body trailing end coating 803 interconnecting with body outside wall coating 805 interconnecting with body groove coating 807 interconnecting with body flange periphery coating 809 interconnecting with body forward end, outer coating 811 terminating at a nut contact point such as a raised contact 804 which may be electrically conductive or rendered conductive by the body circuit coating.

Figure 8C:
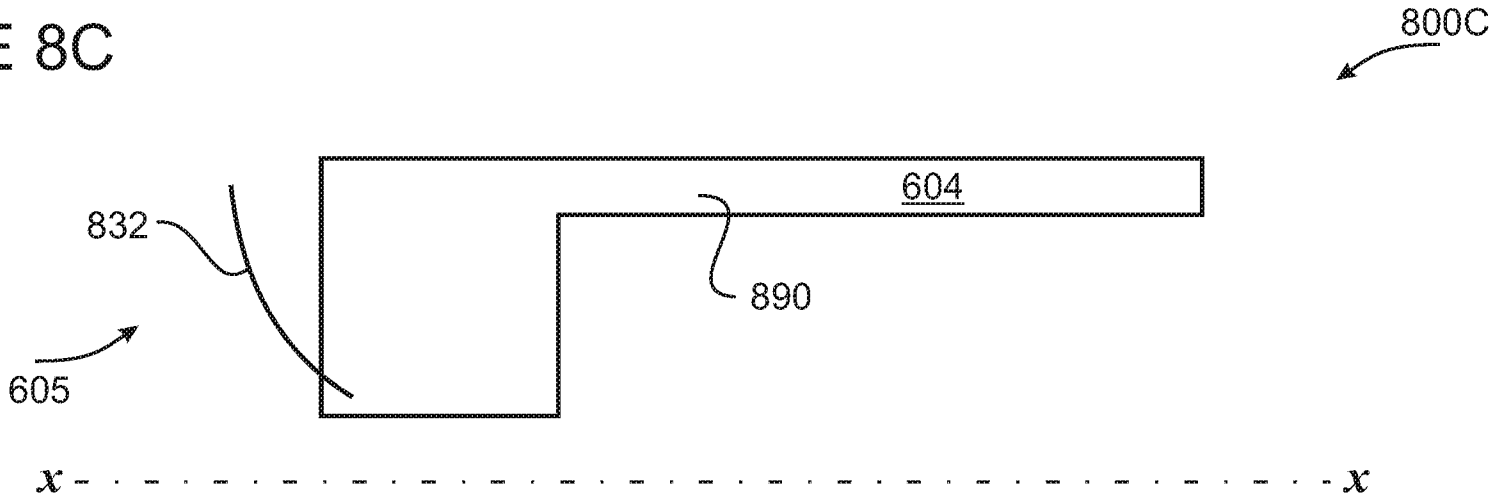

Referring to the body portion 800C of FIG. 8C, the deformable body part 605 of the body 604 includes an electrically conductive body forward face wiper 832. In some embodiments wettable surfaces of the body are coated, for example during submersion, with an electrical conductor. Such a conductive coating application enables both of the above mentioned "body to post circuit" and the "ex post circuit." In other embodiments, only portions of the wettable body surface bear an electrically conductive coating.

Figure 8D:
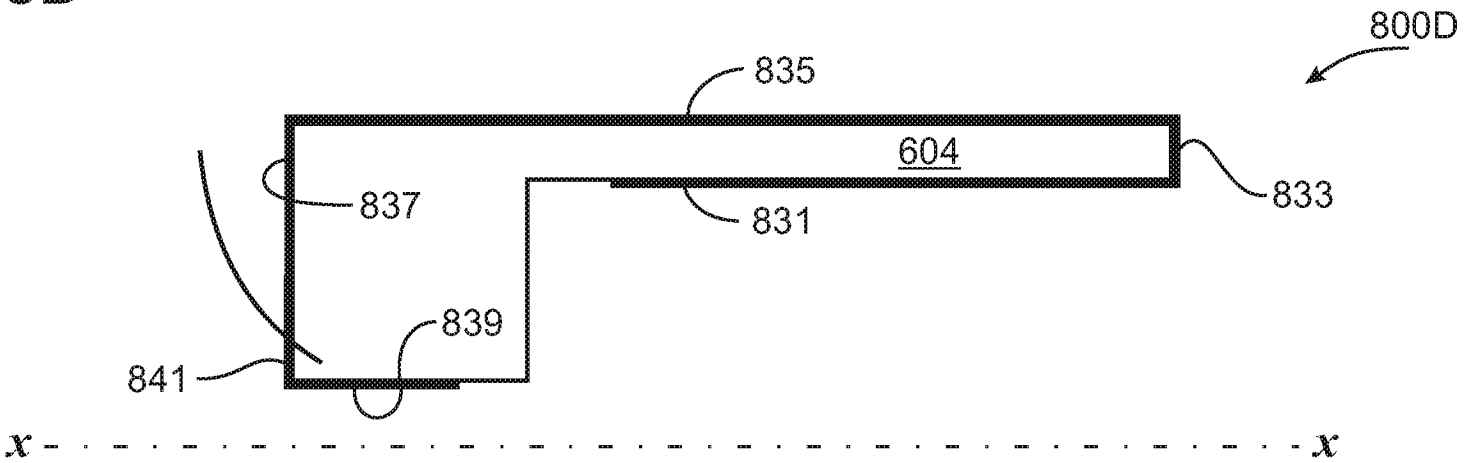

Referring to the body portion 800D of FIG. 8D, the figure illustrates the body of FIG. 8C with a first partial body coating that enables the body to post circuit and/or a second partial body coating that enables the ex post circuit. Coated body regions enabling the body to post circuit include body throat coating where the body grasps a metal post 839 interconnecting body forward end, inner coating 841 terminating at the wiper. Coated body regions enabling the ex post circuit include body inside wall coating 831 interconnecting with body trailing end coating 833 interconnecting with body outside wall coating 835 interconnecting with body forward end, outer coating 837 terminating at the wiper.

Figure 8E:
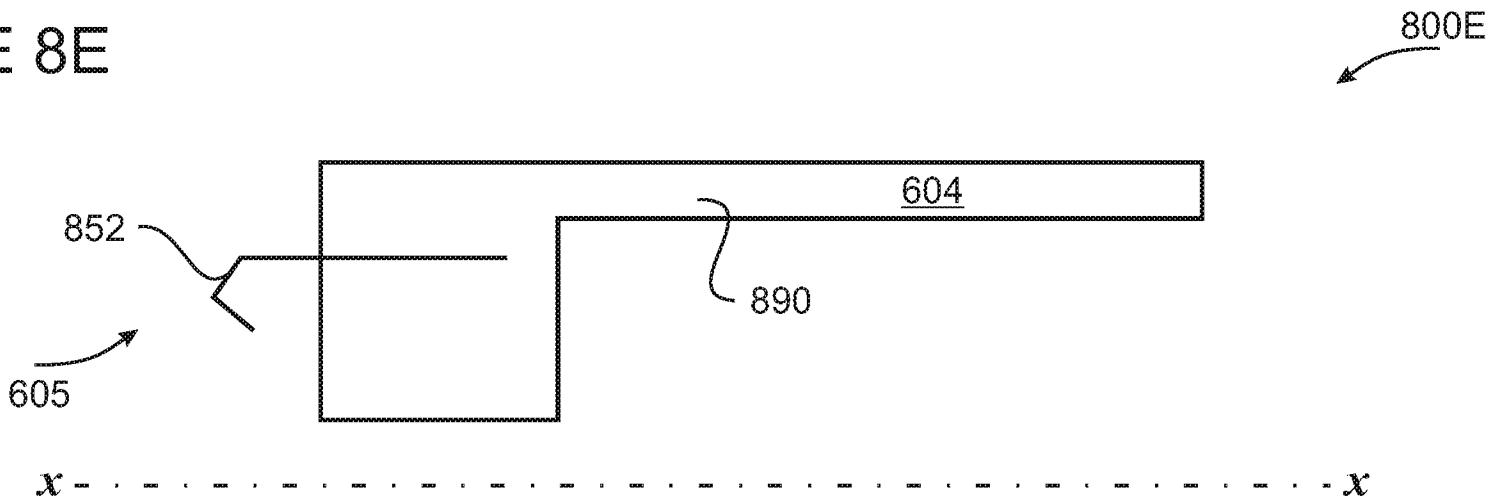

Referring to body portion 800E of FIG. 8E, the deformable body part 605 of the body 604 includes an electrically conductive body forward face extension 852. In some embodiments wettable surfaces of the body are coated, for example during submersion, with an electrical conductor. Such a conductive coating application enables both of the above mentioned "body to post circuit" and the "ex post circuit." In other embodiments, only portions of the wettable body surface bear an electrically conductive coating.

Figure 8F:
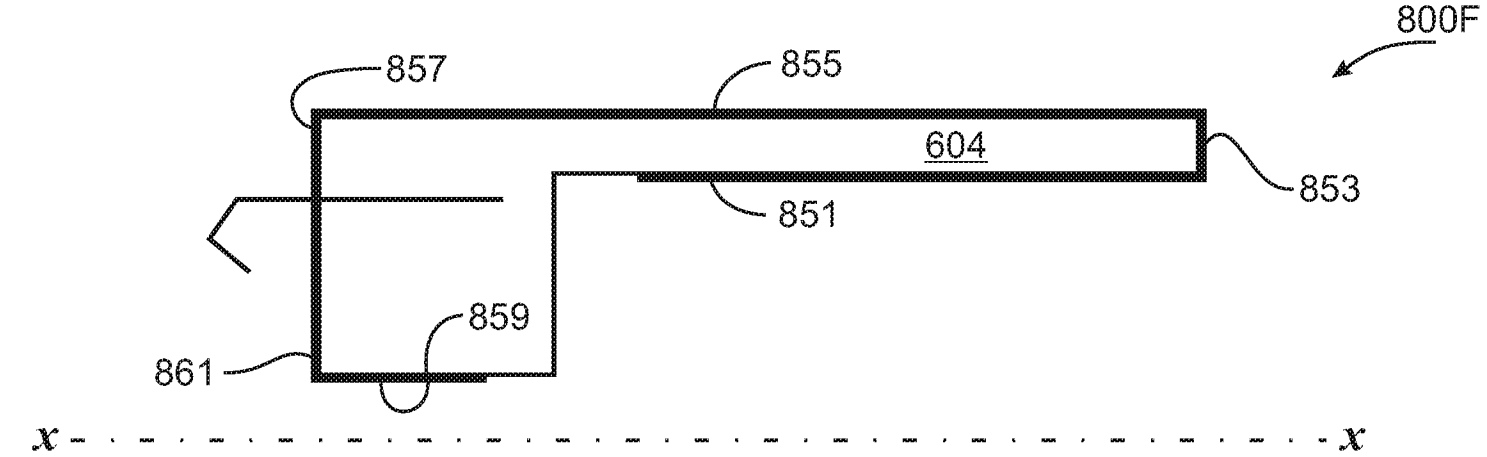

Referring to the body portion 800F of FIG. 8F, the figure illustrates the body of FIG. 8E with a first partial body coating that enables the body to post circuit and/or a second partial body coating that enables the ex post circuit. Coated body regions enabling the body to post circuit include body throat coating where the body grasps a metal post 859 interconnecting body forward end, inner coating 861 terminating at the extension. Coated body regions enabling the ex post circuit include body inside wall coating 851 interconnecting with body trailing end coating 853 interconnecting with body outside wall coating 855 interconnecting with body forward end, outer coating 857 terminating at the extension.

Figure 8G:
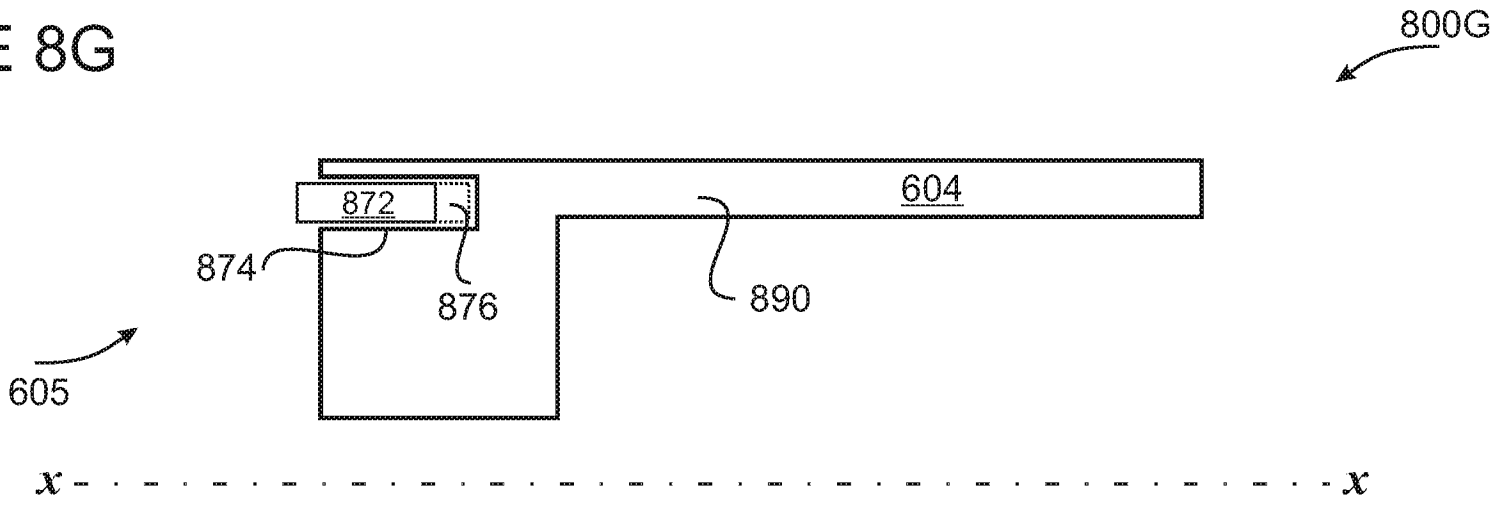
Figure 8H:
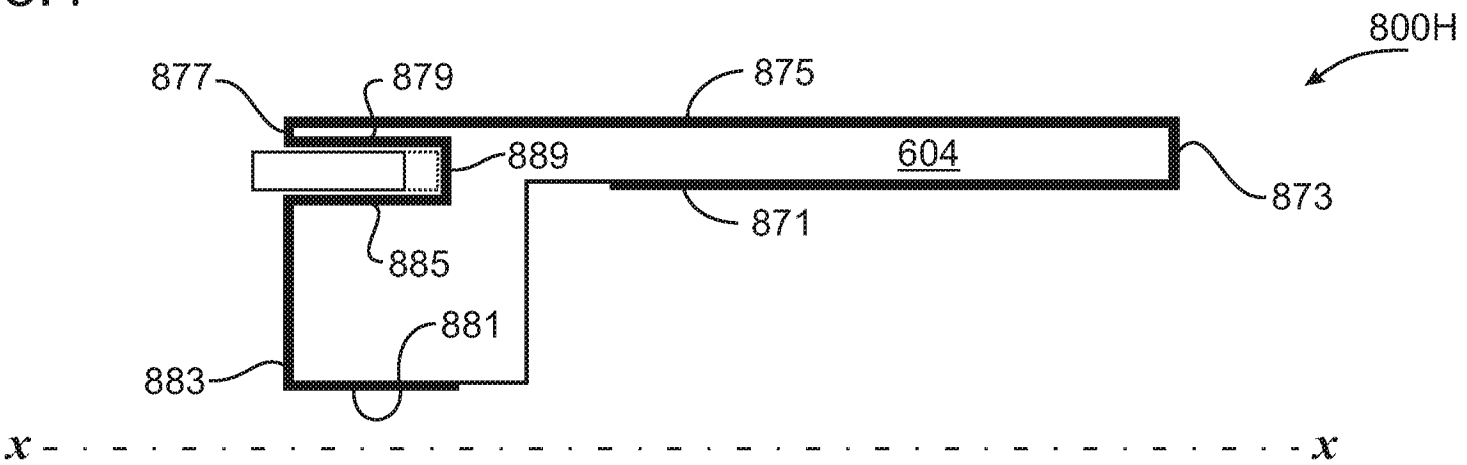

Referring to the body portion 800G of FIG. 8G, the deformable body part 605 of the body 604 includes an electrically conductive slide 872 inserted in body end face cavity 874 and in some embodiments urged to protrude from the cavity by a resilient cavity packing member such as a spring or elastomer 876. In various embodiments, one or more slides are used in respective cavities and in various embodiments a single circular slide is fitted in a cylindrical cavity. The protruding slide is designed to press against a nut as at the nut flange rear face 325. In some embodiments wettable surfaces of the body are coated, for example during submersion, with an electrical conductor. Such a conductive coating application enables both of the above mentioned "body to post circuit" and the "ex post circuit." In other embodiments, only portions of the wettable body surface bear an electrically conductive coating.

Referring to the body portion 80011 of FIG. 811, the figure illustrates the body of FIG. 8G with a first partial body coating that enables the body to post circuit and/or a second partial body coating that enables the ex post circuit. Coated body regions enabling the body to post circuit include body throat coating where the body grasps a metal post 881 interconnecting body forward end, inner coating 883, interconnecting body cavity inner wall coating 885 which interconnects with the conductive slide 872. In various embodiments, one or both of cavity back wall coating 889 and cavity outer wall coating 879 interconnect with cavity inner wall coating 885. Coated body regions enabling the ex post circuit include body inside wall coating 871 interconnecting with body trailing end coating 873 interconnecting with body outside wall coating 875 interconnecting with body forward face outer coating 877 interconnecting with body cavity outer wall coating 879 which interconnects with the conductive slide 872. In various embodiments, one or both of cavity back wall coating 889 and cavity inner wall coating 885 interconnect with cavity outer wall coating 879.

Concerning the electrically conductive coatings mentioned above, plastics above are typically not electrical conductors but can be rendered conductive, for example through the use of admixed conductors and/or specialized conductive coatings.

The connector body 604 with a plastic substrate 890 can be rendered conductive using various coatings including conductive paints and metallizing coatings. Use of one or more of these processes enables electrical conductivity to be controlled such as through the selection of the conductive material used and/or the conductive cross-section of the finished conductor. As skilled artisans will appreciate, typical body circuits and coatings forming body circuits are, in various embodiments, thin by comparison to the average thickness of the substrate to which they are applied.

Common metallization methods include vacuum metallization/physical vapor deposition, arc and flame spraying, and plating/electroplating. Metallized transfer films may also be applied, for example by adhesion or shrinkage, to the surface of a substrate. Using these methods, plastic body substrates can be coated and/or partially coated with metals including copper, nickel, silver, gold, chrome, tin, graphite, and aluminum. Skilled artisans will appreciate that numerous plastic compositions can be plated with one or more of the methods mentioned above. For example, a acrylonitrile butadiene styrene ("ABS"), polycarbonate, polyether imide (PEI), polystyrene, urethane, nylon, polyether ether ketone (PEEK), epoxy, xylex, xenoy, and polyphthalamide provide substrates suited for various applications.

Figure 9:
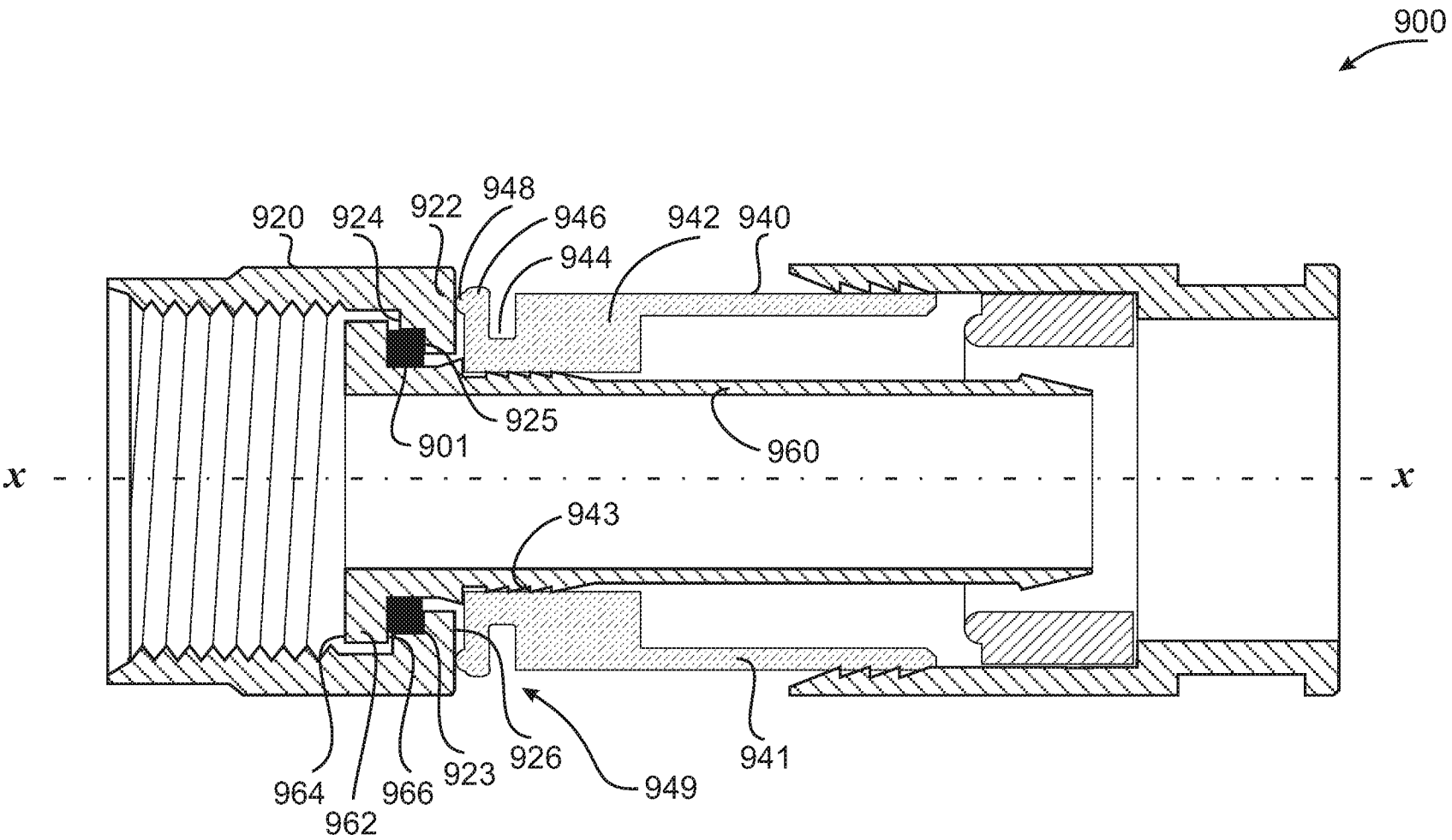
FIG. 9 is a fourth embodiment of the present invention.

FIG. 9 shows a cross-section of a ready for assembly coaxial cable connector 900. The connector includes a coupling or nut 920, a body 940 with a deformable body part 949 and a hollow post 960 rotatably engaged with the nut and fixedly engaged with the body at a body throat 943 of a body neck 942. A nut annular flange 922 with a throat such as a stepped throat 923 encircles the post and lies between a post annular flange 962 and the body 940. The nut annular flange presents first and second forward faces 924, 925 wherein the first forward face is radially outward of the second forward face. The nut annular flange also presents a rear face 926. The post flange 962 presents a forward face 964 and a rear face 966.

In various embodiments, an annular post spacer 901 encircles the post and is located between the post flange 962 and the nut flange 922. As shown, the post spacer has a square or rectangular cross-section. However, the post spacer cross-section may be chosen as required to fit in the space bounded by the post 960 and the nut 920. For example, the post spacer cross-section may take any suitable uncompressed shape such as a shape illustrated by FIGS. 5A through 5G and may be made from any one or more of the spacer materials mentioned above. As described above, some complaint spacers operate to fill adjoining voids when squeezed.

In various embodiments, a deformable body part 949 contacts the nut at a location such as the nut flange rear face 926. The deformable body part provides a resilient body engagement with the nut. As shown, a body flange 946 adjacent to a circumferential groove 944 is in a plane normal to the connector axis X-X. The body flange is a deformable body part with a contact nub 948 extending therefrom and contacting the nut flange rear face in a resilient engagement. One of several exemplary deformable body parts may be chosen according to embodiments described above and shown in FIGS. 8A-H.

The connector body 940 includes a plastic substrate 941 and a body circuit borne by the plastic substrate. As described above, the body circuit may include one or both of a "body to post circuit" and an "ex post circuit" implemented with any of the body circuits described above including the body circuits of FIGS. 8A-H. Body circuits may be implemented with a suitable electrically conductive coating such as any one or more of the electrically conductive coatings mentioned above.

In operation, embodiments of the connectors 200A, 300A, 600, 900 disclosed herein provide for terminating a coaxial cable 255 and enabling transfer of radio frequency signals transported by the coaxial cable to a port mated 201 with the connector. Embodiments of the connector utilize one or both an insulating post spacer 313, 901 and a body to nut contactor such as a deformable body part 605, 949. While the insulating post spacer blocks ground path continuity from the post 306, 960 to the nut 302, 920, body circuit(s) render the otherwise non-conducting body 304, 604, 940 conductive and provide circuits including one or both of a "body to post circuit" and an "ex post circuit."

In various embodiments, the nut flange 370, 922 is urged forward by the body to nut contactor 605, 949 and urged rearward by the resilient post spacer 313, 901, the nut tends to remain in mechanical contact with the body and thus in electrical continuity with the body circuit(s). In a manner of speaking, the body to nut contactor and the post spacer follow the nut flange as it moves back and forth along the connector axis X-X.

Embodiments of the disclosed connector therefore provide a male F-type coaxial cable connector with enhanced ground continuity from coaxial cable braid to mating port ground contact while utilizing body circuits borne by an electrically non-conducting body substrate such as a plastic.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A connector that is a male F-type coaxial cable connector comprising:

a nut, body, and post arranged about a central axis, the nut having a nut mouth opposite a nut annular flange, the nut mouth for receiving a port;

the nut annular flange extends radially inward and defines an aperture proximate the post, the aperture encircles the post and lies between a post annular flange and the body;

the nut annular flange presents a forward face and a rear face;

a resilient ring is between a post flange rear face and the aperture;

a biasing pusher having a free end configured to push the nut annular flange toward the post annular flange and a part of the biasing pusher at a body end that faces the nut;

the biasing pusher free end is at the end of a resilient body arm formed by a body groove with opposed groove walls, one wall of the groove forming a backside of the resilient body arm;

formation or enlargement of a gap longitudinally separating the nut annular flange from the post annular flange is resisted by action of the resilient body arm; and the nut annular flange is stepped and the forward face includes a first forward face and second forward face, the first forward face being radially outward of the second forward face.

2. A connector that is a male F-type coaxial cable connector comprising:

a nut, body, and post arranged about a central axis, the nut having a nut mouth opposite a nut annular flange, the nut mouth for receiving a port;

the nut annular flange extends radially inward and defines an aperture proximate the post, the aperture encircles the post and lies between a post annular flange and the body;

the nut annular flange presents a forward face and a rear face;

a resilient ring is between a post flange rear face and the aperture;

a biasing pusher having a free end configured to push the nut annular flange toward the post annular flange, a part of the biasing pusher at a body end that faces the nut;

a body end face cavity facing the nut; and, a conductive slide urged by a spring in the body end face cavity while it extends from the body end face cavity.

3. The connector of claim 2 wherein the nut annular flange is contacted by the resilient ring and by the spring urged conductive slide such that during nut movement toward the post flange the resilient ring is compressed.

4. The connector of claim 3 wherein formation or enlargement of a gap longitudinally separating the nut annular flange from the post annular flange is resisted by action of the spring urged conductive slide.

5. The connector of claim 4 wherein the nut annular flange is stepped and the forward face includes a first forward face and second forward face, the first forward face being radially outward of the second forward face.

6. A male F-type coaxial cable connector comprising:

a nut, body, and post arranged about a central axis;

the nut having a nut mouth extending from a nut back wall;

the nut for receiving a port;

the nut back wall extending radially inward and defining an aperture proximate the post;

a post shank and a post end flange;

the nut rotatably coupled with the body via the post;

a spacer interposed between the post end flange and the nut back wall; and, wherein the spacer electrically isolates the post from the nut.

* * * * *